US007583924B2

(12) United States Patent
Tsueda et al.

(10) Patent No.: US 7,583,924 B2
(45) Date of Patent: Sep. 1, 2009

(54) FIXING DEVICE FOR IMAGE FORMING APPARATUS

(75) Inventors: Yoshinori Tsueda, Fuji (JP); Satoshi Kinouchi, Shinjuku (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/062,010

(22) Filed: Apr. 3, 2008

(65) Prior Publication Data

US 2008/0187373 A1 Aug. 7, 2008

Related U.S. Application Data

(62) Division of application No. 11/407,756, filed on Apr. 20, 2006, now abandoned.

(51) Int. Cl.
*G03G 15/20* (2006.01)

(52) U.S. Cl. ..... 399/328; 399/330

(58) Field of Classification Search ..... 399/328, 399/333

See application file for complete search history.

(56) References Cited

U.S. PATENT DOCUMENTS

2005/0008413 A1 1/2005 Takagi et al.

FOREIGN PATENT DOCUMENTS

| | | |
|---|---|---|
| JP | 06-242695 | 9/1994 |
| JP | 07-036304 | 2/1995 |
| JP | 2003-263054 | 9/2003 |
| JP | 2004-191514 | 7/2004 |

*Primary Examiner*—David M Gray
*Assistant Examiner*—Erika Villaluna
(74) *Attorney, Agent, or Firm*—Turocy & Watson, LLP

(57) ABSTRACT

In a fixing device for an image forming apparatus of the invention, circumferences of both side parts of an elastic layer are made larger than a circumference of a central part, and the expansion of a foamed rubber layer is absorbed by space between the elastic layer and a metal conductive layer. Thereby, the hardness of a heat roller at the time of fixing is made nearly uniform across the entire length in the shaft direction. The contact area of a core member and the elastic layer in the both side parts of the heat roller is made larger, and the stress per unit area generated in the elastic layer due to contact with the pressure roller is reduced.

6 Claims, 5 Drawing Sheets

FIXING DEVICE FOR IMAGE FORMING APPARATUS

CROSS-REFERENCE TO RELATED APPLICATIONS

This application claims the benefit of priority from and is a division of application Ser. No. 11/407,756 filed on Apr. 20, 2006, the entire contents of which are incorporated herein by reference.

BACKGROUND OF THE INVENTION

1. Field of the Invention

The present invention relates to a fixing device for an image forming apparatus mounted in an image forming apparatus such as a copier, printer, and facsimile for heating and fixing toner images.

2. Description of the Background

As a fixing device used for an image forming apparatus such as an electrophotographic copier and printer, there is a fixing device for inserting sheet paper through a nip formed between a heat roller and a pressure roller and heating, pressurizing, and fixing toner images. Recent years, as a heat-type fixing device, there has been a device in which a metal conductive layer is provided in a heat roller and the metal conductive layer is heated by an induction heating method. The induction heating method is to heat the heat roller by supplying predetermined power to an induction heating coil to generate a magnetic field and instantaneously heating the metal conductive layer with eddy current produced in the metal conductive layer by the magnetic field. In such a heat roller, sometimes an elastic layer is provided outside of a metal core material of the heat roller and the surface of the elastic layer is covered by the metal conductive layer in order to secure a nip width required for fixing between the heat roller and the pressure roller. The elastic layer of the heat roller is made of foamed rubber formed by foaming a silicon rubber material, sponge, or the like, and deforms by the pressure of the pressure roller to form the nip.

However, in the case where the elastic layer is provided between the core material and the metal conductive layer of the heat roller, the coefficient of thermal expansion of the elastic layer such as sponge having fine bubbles is higher than the coefficient of thermal expansion of the metal conductive layer. Accordingly, when the heat roller is heated, the hardness of the heat roller becomes nonuniform in the longitudinal direction thereof due to the difference in coefficient of thermal expansion between the elastic layer and the metal conductive layer. The nonuniformity of hardness of the heat roller in the longitudinal direction causes changes in nip width and heat roller shape and adversely affects the fixing property.

In order to avoid this, conventionally, the elastic layer is formed in a dumbbell shape and the outer diameter of the center part is made smaller than the outer diameters of the both side parts in the longitudinal direction. Thereby, in the central part in the longitudinal direction of the heat roller, space is provided between the elastic layer and the metal conductive layer. Because of the space, the metal conductive layer is prevented from being pushed up from inside by the thermal expansion of the elastic layer when the heat roller is heated, and the hardness of the heat roller in the longitudinal direction is held uniform.

However, in the case where the elastic layer is formed in a dumbbell shape, no load of pressure roller is applied to the central part of the heat roller until the heat roller reaches warm-up temperature. Accordingly, the load due to contact with the pressure roller concentrates on both side parts of the heat roller until the heat roller reaches warm-up temperature. In addition, the elastic layer made of foamed rubber, sponge, or the like is lower in strength than metal cores. Accordingly, there is a possibility that, when the load by pressure of the pressure roller is applied to the both side parts of the heat roller, the elastic layer having lower strength is broken at the boundary part between the core material and the elastic layer and the life of the heat roller becomes shorter.

Therefore, development of a fixing device for an image forming apparatus is desired, in a fixing device for heating and fixing by a heat roller in which an elastic layer is provided around a core material and the surface thereof is covered by a metal conductive layer, a good fixing property can be obtained by holding the hardness of the heat roller in the longitudinal direction uniform and a longer life of the heat roller can be obtained by preventing breakage of the elastic layer at the boundary part between the core material and the elastic layer regardless of pressure contact with a pressure roller.

SUMMARY OF THE INVENTION

Accordingly, an advantage of the present inventions is, in a fixing device for heating and fixing sheet paper by a heat roller in which the surface of an elastic layer provided around a core material is covered by a metal conductive layer, to provide a fixing device for an image forming apparatus for obtaining a longer life of the heat roller by reducing stress on the elastic layer at the boundary part between the core material and the elastic layer to prevent breakage of the elastic layer.

To achieve the above advantage, one aspect of the present invention is to provide a fixing device for an image forming apparatus including: a heating and rotating member formed by covering a surface of an elastic layer formed on an outer periphery of a core member with a metal conductive layer; a heating mechanism that heats the metal conductive layer; a pressurizing member that transports a recording medium together with the heating and rotating member while nipping and caring the recording medium in between; and a bonding member intervening between the elastic layer and the metal conductive layer in both side parts of the heating and rotating member and having a larger bonding area in one side part at an opposite side than a drive side part in a shaft direction of the heating and rotating member.

DETAILED DESCRIPTION OF THE INVENTION

Figure 1:
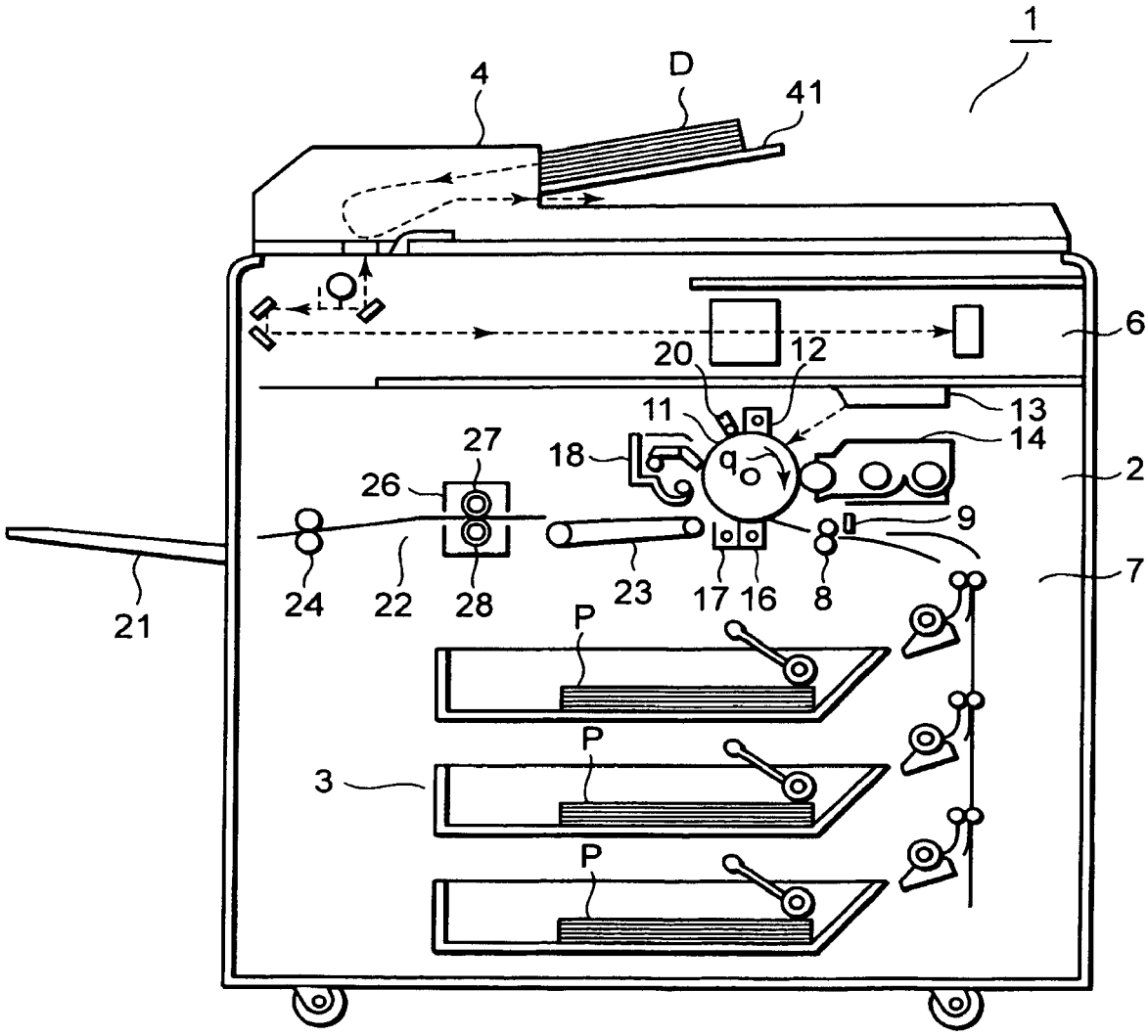
FIG. 1 is a schematic configuration diagram showing an image forming apparatus of the first embodiment of the invention.

The first embodiment of the invention will be described in detail by taking the accompanying drawings as examples as below. FIG. 1 is a schematic configuration diagram showing an image forming apparatus 1 in which a fixing device 26 of the embodiment of the invention is mounted. The image forming apparatus 1 includes a cassette mechanism 3 for supplying paper P as a fixed medium in an image forming part 2, and includes a scanner part 6 for reading document D supplied by an automatic document feeder 4 on the upper surface thereof. A resist roller 8 is provided in a transport path 7 from the cassette mechanism 3 to the image forming part 2.

The image forming part 2 has, around a photoconductive drum 11, a charging device 12 for uniformly charging the photoconductive drum 11 sequentially according to the rotational direction of arrow q of the photoconductive drum 11, a laser exposure device 13 for forming a latent image based on image data from the scanner device 6 on the charged photoconductive drum 11, a developing device 14, a transfer charger 16, a detachment charger 17, a cleaner 18, and a static elimination LED 20. The image forming part 2 forms a toner image on the photoconductive drum 11 in the image forming process by a known electrophotographic method and transfers it to the paper P.

At the downstream of the image forming part 2 in the transport direction of paper P, a paper eject transport path 22 for transporting the paper P on which the toner image has been transferred in a direction of a paper eject part 21 is provided. In the paper eject transport path 22, a transport belt 23 for transporting the paper P separated from the photoconductive drum 11 to the fixing device 26 and a paper eject roller 24 for ejecting the paper P that has passed through the fixing device 26 to the paper eject part 21 are provided.

Figure 2:
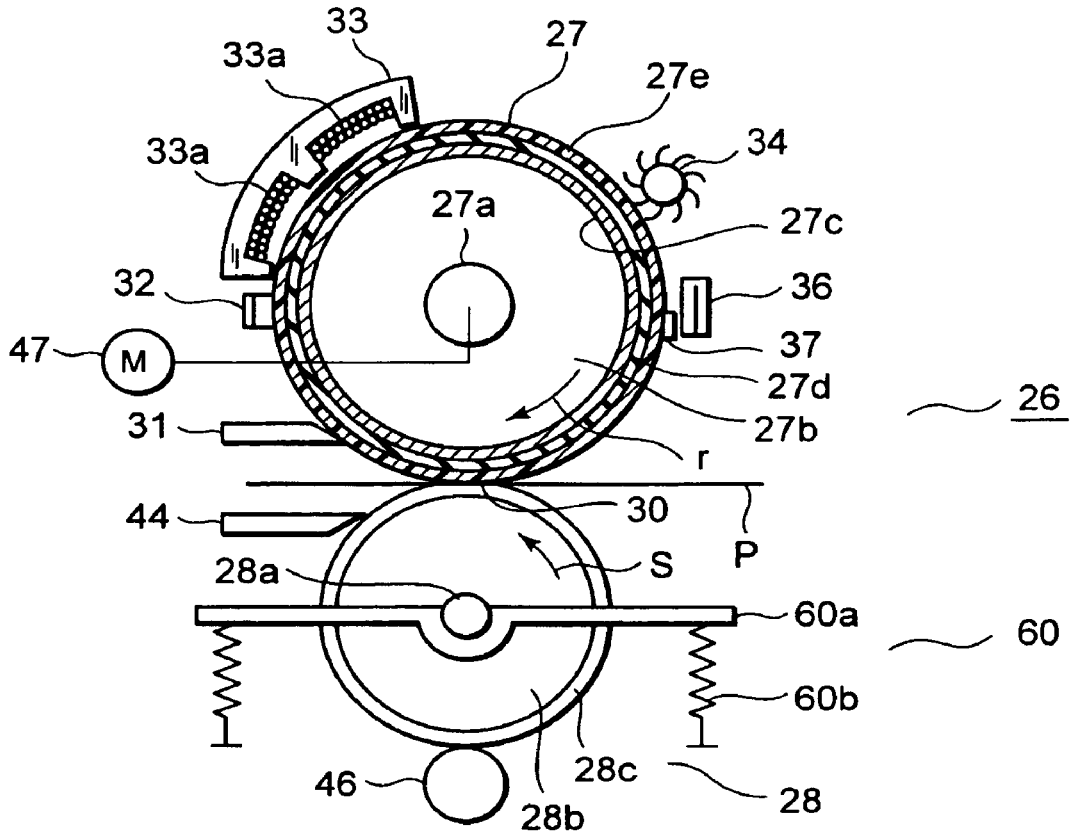
FIG. 2 is a schematic arrangement diagram of a fixing device of the first embodiment of the invention seen from a direction perpendicular to a shaft of a heat roller.

Next, the fixing device 26 will be described. FIG. 2 is a schematic configuration diagram of the fixing device 26. The fixing device 26 has a heat roller 27 as a heating and rotating member and a pressure roller 28 as a pressurizing member. The fixing device 26 has a motor 47 for supplying a rotational force to a core member 27*a* of the heat roller 27. The pressure roller 28 pushes up a shaft member 28*a* by a bearing member 60 and makes pressure contact with the heat roller 27 with pressure of 40 kg. The bearing member 60 constantly presses a bearing bar 60*a* supporting the shaft member 28*a* toward the heat roller 27 with a spring 60*b*. When the pressure roller 28 is brought into pressure contact with the heat roller 27, the heat roller 27 surface elastically deforms. Thereby, a nip 30 having a fixed contact width in the transport direction of sheet paper is formed between the heat roller 27 and the pressure roller 28.

Around the heat roller 27, along the rotational direction of arrow r of the heat roller, a detachment claw 31 for preventing wrapping of paper P after fixing, a thermistor 32 for sensing surface temperature of the end of the heat roller 27, an induction heating unit 33 as an induction heating mechanism, a cleaning unit 34, an infrared temperature sensor 36 for non-contact sensing of surface temperature of the heat roller 27, and a thermostat 37 for sensing abnormality of the surface temperature of the heat roller 27 and shutting off the heating are provided. For example, the heat roller 27 has a foamed rubber layer 27*b* as an elastic layer, a metal conductive layer 27*c*, a silicon rubber layer 27*d*, and a release layer 27*e* around the core member 27*a* of 20 mm in diameter, and a diameter of 40 mm.

Around the pressure roller 28, along the rotational direction of arrow s of the pressure roller, a detachment claw 44 for preventing wrapping of paper P and a cleaning roller 46 are provided. For example, the pressure roller 28 has a silicon rubber layer 28*b* having elasticity and a release layer 28*c* made of fluorine-containing rubber or the like around the shaft member 28*a*, and a diameter of 40 mm.

Figure 3:
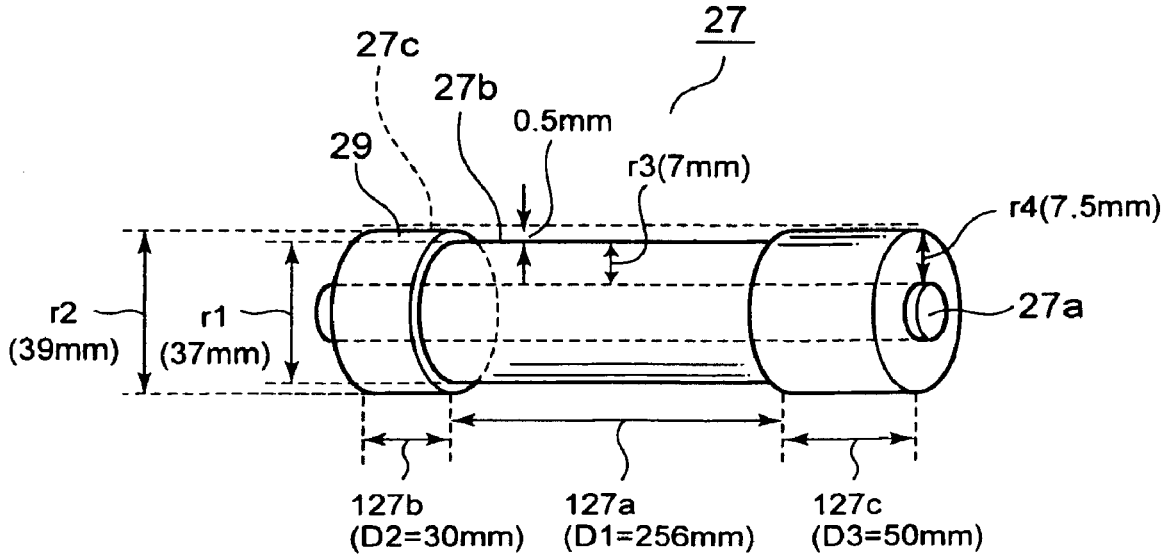
FIG. 3 is a schematic explanatory diagram showing the heat roller of the first embodiment of the invention.

The foamed rubber layer 27*b* has passed through the foaming process at the time of manufacturing, and is formed by silicon foamed rubber formed by foaming silicon rubber or the like, for example. The metal core member 27*a* is formed by iron, for example, and the foamed rubber layer 27*b* is bonded to the outer periphery thereof. As shown in FIG. 3, in the foamed rubber layer 27*b*, the thicknesses r4 of both side parts 127*b*, 127*c* in the shaft direction are formed in 7.5 mm, and the thickness r3 of the central part 127*a* is formed in 7 mm. Thereby, the outer diameter r1 of the central part 127*a* of the foamed rubber layer 27*b*0 is 37 mm, and the outer diameters r2 of the both side parts 127*b*, 127*c* are 39 mm.

Further, in the central part 127*a* in the shaft direction of the heat roller 27, space of about 0.5 mm is formed between the foamed rubber layer 27*b* and the metal conductive layer 27*c*. In the foamed rubber layer 27*b*, the length D1 of the central part 127*a* in the shaft direction is formed in 256 mm, the length D2 of the side part 127*b* at the drive side to which the motor 47 is connected is formed in 30 mm, and the length D3 of one side part 127*c* at the opposite side to the drive side is formed in 50 mm. In one side part 127*b* of the foamed rubber layer 27*b*, an air release 29 for releasing air in the space between the metal conductive layer 27*c* and itself when the foamed rubber layer 27*b* thermally expands is formed.

The metal conductive layer 27*c* of the heat roller 27 is made of aluminum (Al) of 0.02 to 0.1 mm in thickness, for example, and covers the foamed rubber layer 27*b*. The material of the metal conductive layer 27*c* is not limited as long as it generates heat by eddy current such as nickel (Ni) or iron (Fe). The silicon rubber layer 27*d* is formed in thickness of about 200 μm. The release layer 27*e* is formed by fluorocarbon polymer (PFA or PTFE (polytetrafluoroethylene), or mixture of PFA and PTFE) in thickness of 30 μm. The both side parts 127*b*, 127*c* of the foamed rubber layer 27*b* and the metal conductive layer 27*c* are bonded together by a silicon-series heat resistant adhesive. That is, the bonding area of the one side part 127*c* at the opposite side to the drive side is larger than the bonding area of the side part 127*b* at the drive side.

The induction heating unit 33 has an induction heating coil 33*a*. When drive current is supplied to the induction heating coil 33*a*, a magnetic field is generated. The induction heating unit 33 generates eddy current in the metal conductive layer 27*c* by the magnetic field to heat the metal conductive layer 27*c*.

Next, the operation will be described. When the power of the image forming apparatus 1 is turned ON, warm-up is started. Thereby, the motor 47 is driven and the heat roller 27 is rotated in the arrow r direction. Further, the drive current is supplied to the induction heating coil 33*a* and the metal conductive layer 27*c* is heated. Thereby, the pressure roller 28 is drivenly rotated by the heat roller 27.

Until the warm-up is completed, space is formed in the central part 127*a* of the heat roller 27, and the load of the pressure roller 28 by pressure contact is applied only on the both side parts 127*b*, 127*c* of the heat roller 27. Accordingly, in the both side parts 127*b*, 127*c* of the heat roller 27, especially in the one side part 127*c* at the opposite side to the drive side, stress concentrates on the boundary part between the core member 27*a* and the foamed rubber layer 27*b*. Note that, since the bonding area to the metal conductive layer 27*c* of the one side part 127*c* at the opposite side to the drive side is large, the breakage of the boundary part between the core member 27*a* and the foamed rubber layer 27*b* due to distortion is avoided.

Afterward, when the heating of the metal conductive layer 27*c* by the induction heating unit 33 progresses, the foamed rubber layer 27*b* and the metal conductive layer 27*c* thermally expand. Since the coefficient of thermal expansion of the foamed rubber layer 27*b* is higher than that of the metal conductive layer 27*c*, the space in the central part 127*a* of the heat roller 27 is filled with the foamed rubber layer 27*b*, and the foamed rubber layer 27*b* and the metal conductive layer 27*c* are brought into close contact in the central part 127*a* of the heat roller 27. The air in the space in the central part 127*a* of the heat roller 27 is released from the air release 29. The hardness of the heat roller 27 at the time is nearly uniform across the entire length in the shaft direction. Thereby, the nip 30 that enables sufficient fixing of toner images is formed between the heat roller 27 and the pressure roller 28.

When the temperature of the heat roller 27 reaches 170° C. as warm-up completion temperature, at the image forming apparatus 1 main body side, the ready status that the warm-up has been completed is displayed on a control panel (not shown) or the like from the sensing result from the infrared temperature sensor 36. After the heat roller 27 reaches warm-up completion temperature, ready temperature of 160±10° C. is held according to the sensing results of the infrared temperature sensor 36 and the thermistor 32.

Afterward, when printing operation is instructed, the image forming apparatus 1 starts the image formation process. In the image forming part 2, the photoconductive drum 11 rotating in the rotational direction of arrow q is uniformly charged by the charging device 12, applied with a laser beam according to document information by the laser exposure device 13, and an electrostatic latent image is formed thereon. Then, the electrostatic latent image is developed by the developing device 14, and a toner image is formed on the photoconductive drum 11.

The toner image on the photoconductive drum 11 is transferred to paper P by the transfer charger 16. Then, the paper P is detached from the photoconductive drum 11 and transported to the fixing device 26. In the fixing device 26, the paper P is inserted through the nip 30 between the heat roller 27 drivingly rotated by the motor 47 and the pressure roller 28 drivenly rotated, and the toner image is heated, pressurized, and fixed.

At this time, since the pressure generated at the nip 30 is uniform across the entire length of the heat roller 27, the sufficient nip width is secured across the entire length of the heat roller 27. Thereby, the toner image on the paper P is well fixed across the entire length in the scan direction. Further, the stress on the boundary part of the foamed rubber layer 27*b* in contact with the core member 27*a* of the heat roller 27 does not concentrate on the both side parts 127*b*, 127*c* but is nearly uniform across the entire length of the foamed rubber layer 27*b*. Afterward, when the power is turned OFF and the temperature of the heat roller 27 is lowered, space is formed between the foamed rubber layer 27*b* and the metal conductive layer 27*c* in the central part 127*a*.

According to the embodiment, in order to absorb the difference in coefficient of thermal expansion between the foamed rubber layer 27*b* and the metal conductive layer 27*c*, the both side parts 127*b*, 127*c* of the foamed rubber layer 27*b* are formed thicker than the central part 127*a*. Accordingly, at the time of fixing, the hardness of the heat roller 27 is nearly uniform across the entire length in the shaft direction. That is, the nip 30 between the heat roller 27 and the pressure roller 28 can obtain uniform pressure across the entire length of the heat roller 27 in the shaft direction. As a result, good fixing performance can be obtained across the entire length in the scan direction.

Further, according to the embodiment, the bonding area of the foamed rubber layer 27*b* and the metal conductive layer 27*c* in the one side part 127*c* at the opposite side to the drive side is larger than that of the side part 127*b* at the drive side. Therefore, in the one side part 127*c* at the opposite side to the drive side, the stress generated on the boundary part between the core member 27*a* and the foamed rubber layer 27*b* by the pressure contact of the pressure roller 28 is dispersed, and the stress per area is reduced. As a result, in the one side part 127*c* at the opposite side to the drive side, breakage of the boundary part between the core member 27*a* and the foamed rubber layer 27*b* can be prevented and a longer life of the heat roller 27 can be obtained.

Next, the second embodiment of the invention will be described. The second embodiment differs in the structure of the elastic layer of the heat roller in the above described first embodiment, the other structure is the same as that of the first embodiment. Accordingly, in the second embodiment, regarding the same components as those have been described in the above first embodiment, the same signs are assigned and the detailed description thereof will be omitted.

Figure 4:
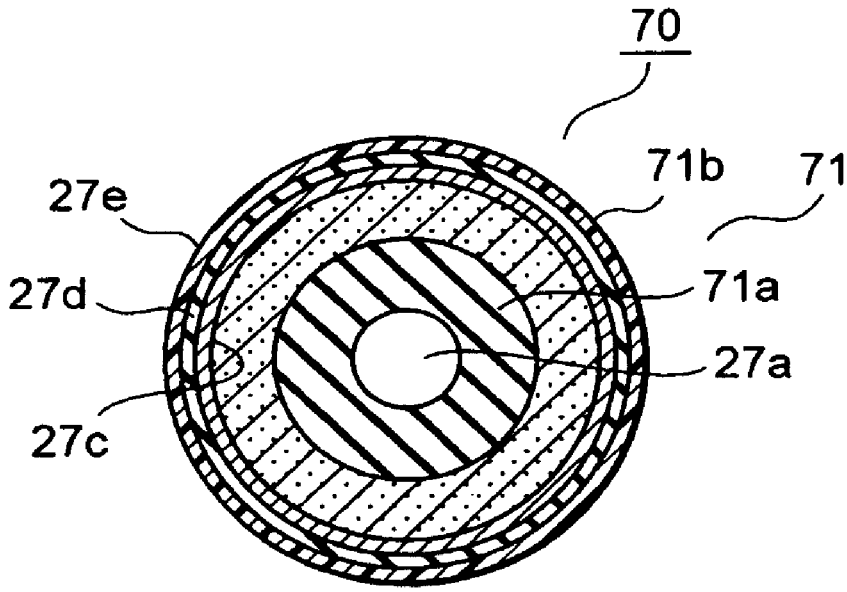
FIG. 4 is a schematic sectional diagram of a heat roller of the second embodiment of the invention seen from a direction perpendicular to a shaft thereof.

In a heat roller 70 of the second embodiment, as shown in FIG. 4, a silicon rubber layer 71 as an elastic layer around the core member 27*a* includes a solid rubber layer 71*a* made of silicon rubber through no foaming process and a foamed rubber layer 71*b* made of silicon rubber through a foaming process. The surface periphery of the silicon layer 71 is covered by the metal conductive layer 27*c*, the silicon rubber layer 27*d*, and the release layer 27*e*.

Figure 5:
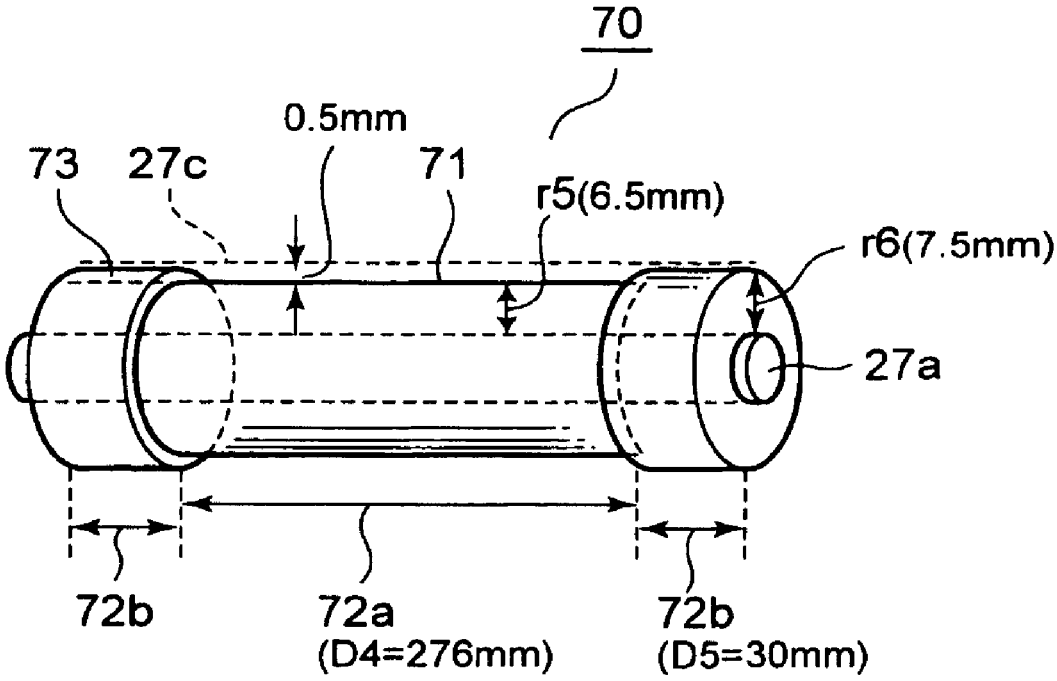
FIG. 5 is a schematic explanatory diagram showing the heat roller of the second embodiment of the invention.

Around the solid rubber layer 71*a*, the foamed rubber layer 71*b* is laminated and bonded by a silicon-series heat resistant adhesive. The foamed rubber layer 71*b* has a uniform thickness of 3 mm in the shaft direction. Thereby, in the silicon layer 71, as shown in FIG. 5, the thickness r5 of the central part 72*a* in the shaft direction is formed in 6.5 mm, and the thicknesses r6 of both side parts 72*b* are formed in 7.5 mm. That is, the inner periphery of the foamed rubber layer 71*b* with lower strength is bonded to the solid rubber layer 71*a* formed around the core member 27*a* with relatively high strength and a larger circumference. The both side parts 72*b* of the silicon layer 71 are bonded to the metal conductive layer 27*c* by a silicon-series heat resistant adhesive. In the central part 72*a* in the shaft direction of the heat roller 70, space of about 1.0 mm is formed between the silicon layer 71 and the metal conductive layer 27*c*. In the silicon layer 71, the length D4 of the central part 72*a* in the shaft direction is formed in 276 mm, and the length D5 of the both side end parts 72*b* is formed in 30 mm. In one side part of the silicon foamed rubber layer 71*b*, as is the case with the first embodiment, an air release 73 for releasing air in the space between the metal conductive layer 27*c* and itself when the silicon layer 71 thermally expands is formed.

In the heat roller 70, space is formed in the central part 72*a* until the warm-up is completed, and the load of the pressure roller 28 by pressure contact is applied only to the both side parts 72*b* of the heat roller 70. Accordingly, in the both side parts 72*b* of the heat roller 70, stress concentrates on the boundary part between the core member 27*a* and the silicon layer 71. Note that the contact surface side of the silicon layer 71 with the core member 27*a* is formed by the solid rubber layer 71*a* with relatively high strength. Further, the foamed rubber layer 71*b* is laminated on the outer periphery of the solid rubber layer 71. That is, the foamed rubber layer 71*b* with greater elasticity but lower strength is bonded to the solid rubber layer 71 having a large diameter. Thereby, the stress generated in the inner periphery of the foamed rubber layer 71*b* due to load of the pressure roller 28 is dispersed. Therefore, the silicon layer 71 avoids the breakage of the boundary part between the core member 27*a* and itself due to distortion without damage in elasticity.

Afterwards, when the heating of the metal conductive layer 27*c* by the induction heating unit 33 progresses, the space in the central part 72*a* of the heat roller 70 is filled by the thermal expansion of the silicon layer 71, and the silicon layer 71 and the metal conductive layer 27*c* are brought into close contact. Therefore, the hardness of the heat roller 70 is nearly uniform across the entire length in the shaft direction. Thereby, the nip 30 that enables sufficient fixing of toner images is formed between the heat roller 70 and the pressure roller 28. Subsequently, the image formation process is performed as is the case with the first embodiment.

According to the embodiment, as is the case with the first embodiment, the nip 30 can obtain uniform pressure across the entire length of the heat roller 70 in the shaft direction at the time of fixing. As a result, uniform and good fixing performance can be obtained across the entire length in the scan direction.

Further, according to the embodiment, the silicon layer 71 has a two-layer structure, and the foamed rubber layer 71*b* is formed by bonding to the outer periphery of the solid rubber layer 71*a*. Therefore, in the both side parts 72*b* of the heat roller 70, the stress generated on the inner periphery of the foamed rubber layer 71*b* by the pressure contact of the pressure roller 28 is dispersed, and the stress per area is reduced. As a result, in the both side parts 72*b* of the heat roller 70, the breakage of the inner periphery of the foamed rubber layer 71*b* can be prevented and a longer life of the heat roller 70 can be obtained.

Although the elastic layer has a two-layer structure of the solid rubber layer and the foamed rubber layer in the second embodiment, the properties of material are not limited as long as the elastic layer can prevent the breakage of the foamed rubber layer. For example, two kinds of foamed rubber layers having different foaming rates may be used. In this case, if the foamed rubber layer with lower foaming rate and higher strength is bonded to the core member, the breakage of the elastic layer at the boundary between the core member and the elastic layer can be prevented and good elastic property can be held. Further, the material of the elastic layer is not limited to silicon.

Next, the third embodiment of the invention will be described. The third embodiment differs in the structure of the bonding part of the solid rubber layer 71*a* and the foamed rubber layer 71*b* of the silicon layer 71 in the above described second embodiment, the other structure is the same as that of the second embodiment. Accordingly, in the third embodiment, regarding the same components as those have been described in the above second embodiment, the same signs are assigned and the detailed description thereof will be omitted.

Figure 6:
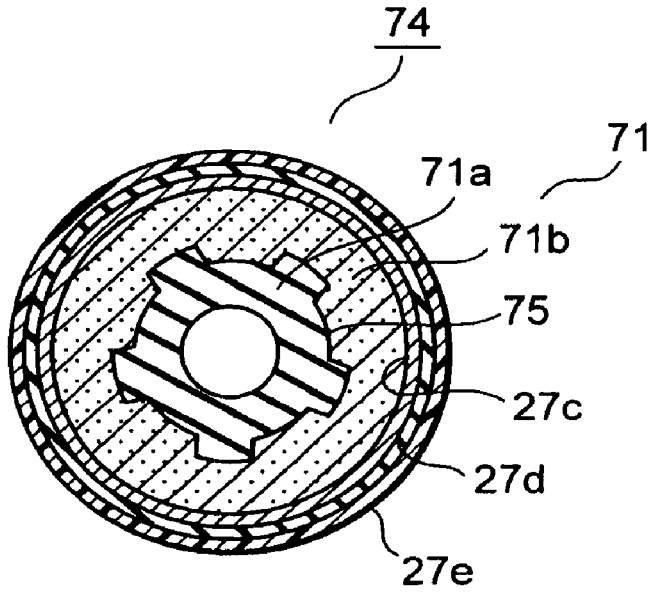
FIG. 6 is a schematic sectional diagram of a heat roller of the third embodiment of the invention seen from a direction perpendicular to a shaft thereof.

In the third embodiment, as shown in FIG. 6, as is the case of the second embodiment, the contact surface side of the silicon layer 71 of a heat roller 74 with the core member 27*a* is formed by the solid rubber layer 71*a* with relatively high strength. Further, the foamed rubber layer 71*b* is laminated on the outer periphery of the solid rubber layer 71. Furthermore, a boundary surface 75 between the solid rubber layer 71*a* and the foamed rubber layer 71*b* is formed in a concavo-convex nested structure. The height difference between the convexity and concavity on the boundary surface 75 is 2 mm.

The surface periphery of the silicon layer 71 is covered by the metal conductive layer 27*c*, the silicon rubber layer 27*d*, and the release layer 27*e*. The both side parts 72*b* of the foamed rubber layer 71*b* and the metal conductive layer 27*c* are bonded by a silicon-series heat resistant adhesive. In the central part 72*a* of the heat roller 74, space of about 0.5 mm is formed between the foamed rubber layer 71*b* and the metal conductive layer 27*c*.

When the power is turned ON as is the case with the above described second embodiment using the heat roller 74 having such a structure, the load by pressure contact with the pressure roller 28 concentrates on the both side parts of the heat roller 74 until the warm-up is completed. The contact surface side of the silicon layer 71 with the core member 27*a* is formed by the solid rubber layer 71*a* with relatively high strength. Further, the foamed rubber layer 71*b* with lower strength is laminated on the outer periphery of the solid rubber layer 71 having a large diameter. Thereby, the stress generated in the inner periphery of the foamed rubber layer 71*b* due to load of the pressure roller 28 is dispersed. Furthermore, the contact area of the solid rubber layer 71*a* and the foamed rubber layer 71*b* is increased by the convexity and concavity of the boundary surface 75 between them. Thereby, the stress generated in the inner periphery of the foamed rubber layer 71*b* is further dispersed. Thereby, the silicon layer 71 avoids the breakage of the formed rubber layer 71*b* with lower strength due to distortion without damage in elasticity.

Afterward, when the warm-up is completed, the image formation process is performed as is the case with the above described second embodiment.

According to the embodiment, as is the case with the second embodiment, the nip 30 can obtain uniform pressure across the entire length of the heat roller 74 in the shaft direction at the time of fixing, and uniform and good fixed images are obtained. Further, according to the embodiment, since the boundary surface 75 between the solid rubber layer 71*a* and the foamed rubber layer 71*b* is formed in the concavo-convex shape, the bonding surface of them can be made larger. Accordingly, until the warm-up is completed, the stress generated in the inner periphery of the foamed rubber layer 71*b* due to pressure contact of the pressure roller 28 is dispersed in the both side parts of the heat roller 74, and, after the warm-up is completed, the stress generated in the inner periphery of the foamed rubber layer 71*b* is sufficiently dispersed across the entire length of the heat roller 74. As a result, the breakage of the inner periphery of the foamed rubber layer 71*b* in the both side parts of the heat roller 74 can be reliably prevented, and an even longer life of the heat roller 70 can be obtained.

By the way, in the third embodiment, the properties of material, ingredients, or the like of the elastic layer having two-layer elastic members are not limited as long as the elastic layer can prevent the breakage of the foamed rubber layer. For example, the elastic layer may be formed using two kinds of foamed rubber layers having different foaming rates. In this case, if the foamed rubber layer with lower foaming rate and higher strength is bonded to the core member, the breakage of the elastic layer at the boundary between the core member and the elastic layer can be prevented and good elastic property can be held. Further, the material of the elastic layer is not limited to silicon.

Next, the fourth embodiment of the invention will be described. The fourth embodiment differs in the structure of the central part in the above described third embodiment, and the other structure is the same as that of the third embodiment. Accordingly, in the fourth embodiment, regarding the same components as those have been described in the above third embodiment, the same signs are assigned and the detailed description thereof will be omitted.

Figure 7:
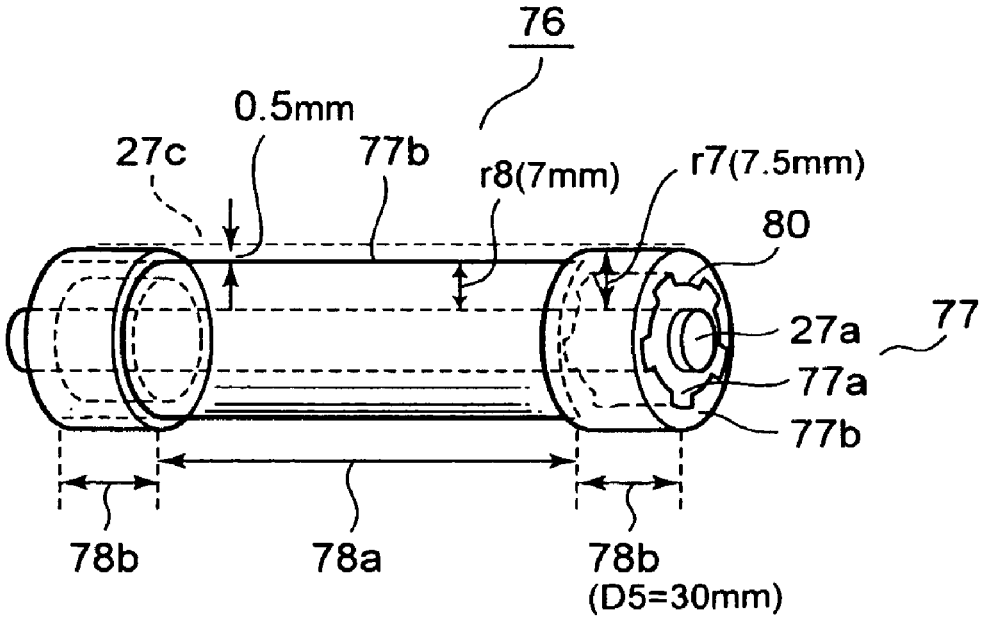
FIG. 7 is a schematic explanatory diagram showing a heat roller of the fourth embodiment of the invention.

In the fourth embodiment, as shown in FIG. 7, both side parts 78*b* of a silicon layer 77 of a heat roller 76 have a two-layer structure of a solid rubber layer 77*a* and a foamed rubber layer 77*b*. Further, a boundary surface 80 between the solid rubber layer 77*a* and the foamed rubber layer 77*b* is formed in a concavo-convex nested structure. The central part 78*b* of the silicon layer 77 includes the foamed rubber layer 77*b* formed around the core member 27*a*. The total thickness r7 of the solid rubber layer 77*a* and the foamed rubber layer 77*b* in the both side parts 78*b* of the heat roller 76 is 7.5 mm, and the thickness r8 of the foamed rubber layer 77*b* in the central part 78*b* is 7 mm.

The surface periphery of the silicon layer 77 is covered by the metal conductive layer 27*c*, the silicon rubber layer 27*d*, and the release layer 27*e*. The both side parts 78*b* of the foamed rubber layer 77*b* and the metal conductive layer 27*c* are bonded by a silicon-series heat resistant adhesive. In the central part 78*a* of the heat roller 76, space of about 0.5 mm is formed between the foamed rubber layer 77*b* and the metal conductive layer 27*c*.

When the power is turned ON as is the case with the above described third embodiment using the heat roller 76 having such a structure, the load by pressure contact with the pressure roller 28 concentrates on the both side parts 78*b* of the heat roller 76 until the warm-up is completed. Note that, in the both side parts 78*b*, since the foamed rubber layer 77*b* is formed around the solid rubber layer 77*a* and the boundary surface between the solid rubber layer 77*a* and itself is formed in the concavo-convex shape, the contact area with the solid rubber layer 77*a* is increased. Thereby, the stress generated in the inner periphery of the foamed rubber layer 71*b* in the both side parts 78*b* of the heat roller 76 is dispersed, and the breakage of the foamed rubber layer 71*b* with lower strength due to distortion is avoided.

Afterward, when the warm-up is completed, the image formation process is performed. At this time, the central part 78*a* of the heat roller 76 obtains elasticity only by the foamed rubber layer 77*b*. Thereby, in the central part 78*a* of the heat roller 76, extremely smooth pressure without possibility of influence by the convexity and concavity of the solid rubber layer 77*a* is obtained across the entire length in the shaft direction.

According to the embodiment, the nip 30 can obtain uniform pressure across the entire length of the heat roller 74 in the shaft direction at the time of fixing, and further, in the central part 78*a*, there is no possibility of influence by the convexity and concavity of the solid rubber layer 77*a*, and uniform good fixed images are obtained. Further, according to the embodiment, since the boundary surface 80 between the solid rubber layer 77*a* and the foamed rubber layer 77*b* is formed in the concavo-convex shape in the both side parts 78*b* of the heat roller 77, the contact area can be made larger. Accordingly, until the warm-up is completed, especially, the stress generated in the inner periphery of the foamed rubber layer 77*b* can be dispersed in the both side parts 78*b* of the heat roller 76. As a result, the breakage of the inner periphery of the foamed rubber layer 77*b* in the both parts 78*a* of the heat roller 76 can be prevented, and a longer life of the heat roller 70 can be obtained.

By the way, in the fourth embodiment, the properties of material, ingredients, or the like of the elastic layer are not limited as is the case with the above described third embodiment. For example, a foamed rubber layer with higher foaming rate and higher elasticity may be laminated on the outer periphery of a foamed rubber layer with lower foaming rate and higher strength. Further, the material of the elastic layer is not limited to silicon.

Next, the fifth embodiment of the invention will be described. The fifth embodiment differs in the structure of the core member and foamed rubber layer in the above described first embodiment, and the other structure is the same as that of the first embodiment. Accordingly, in the fifth embodiment, regarding the same components as those have been described in the above first embodiment, the same signs are assigned and the detailed description thereof will be omitted.

Figure 8:
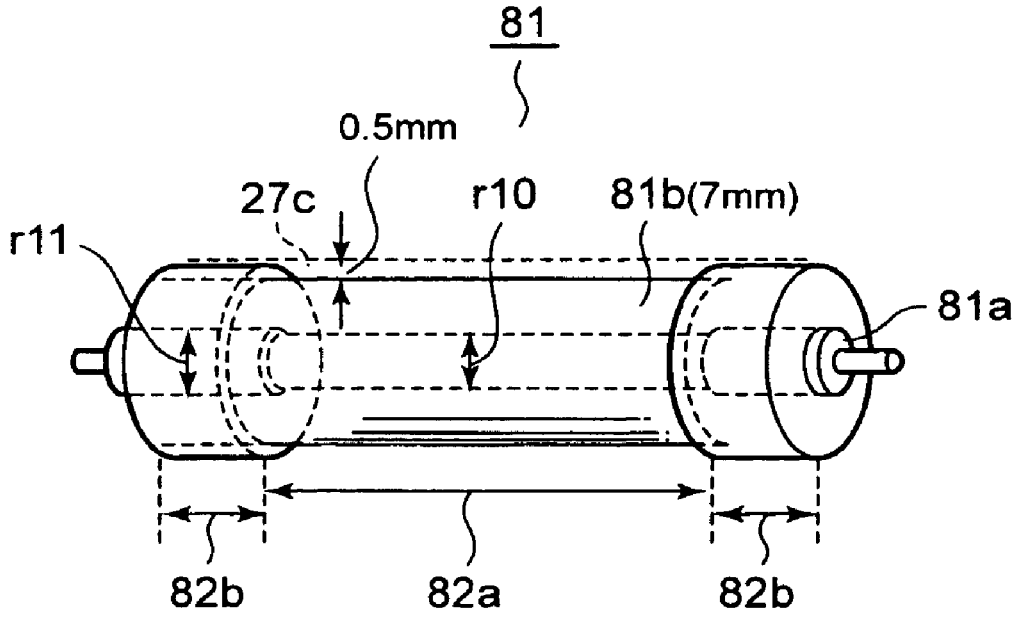
FIG. 8 is a schematic explanatory diagram showing a heat roller of the fifth embodiment of the invention.

In a heat roller 81 of the fifth embodiment, as shown in FIG. 8, the outer diameter r10 of a central part 82*a* in the shaft direction of a core member 81*a* is 23 mm, and the outer diameters r11 of both side parts 82*b* are 25 mm. Around the core member 81*a*, a foamed rubber layer 81*b* is bonded. That is, in the both side parts 82*b* of the heat roller 81 to which a load is applied before completion of warm-up, the outer circumference of the core member 81*a* is made larger. The foamed rubber layer 81*b* has a uniform thickness of 7 mm in the shaft direction. Thereby, the outer diameter of the central part 82*a* of the foamed rubber layer 81*b* is 37 mm, and the outer diameters of the both side parts 82*b* are 39 mm. Thereby, the bonding area of the foamed rubber layer 81*b* to the core member 81*a* is increased.

The surface periphery of the foamed rubber layer 81*b* is covered by the metal conductive layer 27*c*, the silicon rubber layer 27*d*, and the release layer 27*e*. The both side parts 82*b* of the foamed rubber layer 81*b* and the metal conductive layer 27*c* are bonded by a silicon-series heat resistant adhesive. In the central part 82*a* of the heat roller 81, space of about 0.5 mm is formed between the foamed rubber layer 81*b* and the metal conductive layer 27*c*.

When the power is turned ON as is the case with the above described first embodiment using the heat roller 81 having such a structure, a load concentrates on the both side parts 82*b* of the heat roller 81 until the warm-up is completed. Note that, in the both side parts 82*b*, since the outer diameter of the core member 81*a* is made larger, the contact area of the foamed rubber layer 81*b* with the core member 81*a* is increased. Thereby, the stress generated in the inner periphery of the foamed rubber layer 81*b* in the both side parts 82*b* of the heat roller 81 is dispersed, and the breakage of the foamed rubber layer 81*b* with lower strength due to distortion is avoided.

Afterward, when the warm-up is completed, the image formation process is performed.

According to the embodiment, as is the case with the first embodiment, the nip 30 can obtain uniform pressure across the entire length of the heat roller 81 in the shaft direction at the time of fixing, and uniform and good fixed images can be obtained across the entire length in the scan direction. Further, according to the embodiment, since the outer diameter is made larger in the both side parts 82*b* of the core member 81*a*, the contact area with the foamed rubber layer 81*b* is increased. Accordingly, since the stress generated in the inner periphery of the foamed rubber layer 81*b* is dispersed and the breakage of the inner periphery of the foamed rubber layer 71*b* can be prevented in the both side parts 82*b* of the heat roller 81, a longer life of the heat roller 70 can be obtained.

Next, the sixth embodiment of the invention will be described. The sixth embodiment differs in the structure of the core member and foamed rubber layer and in the properties of material of the core member and further the size of the heat roller in the above described first embodiment. The other structure is the same as that of the first embodiment. Accordingly, in the sixth embodiment, regarding the same components as those have been described in the above first embodiment, the same signs are assigned and the detailed description thereof will be omitted.

Figure 9:
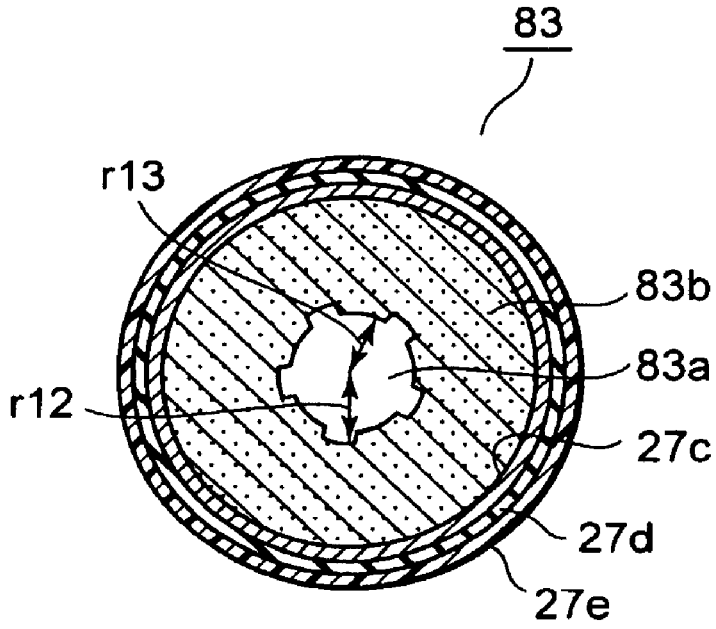
FIG. 9 is a schematic sectional diagram of a heat roller of the sixth embodiment of the invention seen from a direction perpendicular to a shaft thereof.

In the sixth embodiment, as shown in FIG. 9, the outer periphery of a core member 83*a* of an iron heat roller 83 is formed in a concavo-convex shape. The maximum radius r12 of the core member 83*a* is 30 mm, and the minimum radius r13 thereof is 33 mm. The inner periphery of a foamed rubber layer 83*b* formed on the outer periphery of the core member 83*a* meshes with the concavo-convex shape of the core member 83*a* and is bonded to the core member 83*a*. Thereby, the bonding area of the core member 83*a* and the foamed rubber layer 83*b* is increased. The thicknesses of both side parts of the foamed rubber layer 83*b* in the shaft direction are made 0.5 mm thicker than that of the central part. Thereby, the outer diameter of the central part of the foamed rubber layer 83*b* is 44 mm and the outer diameters of the both side parts are 45 mm. The surface periphery of the foamed rubber layer 83*b* is covered by the metal conductive layer 27*c*, the silicon rubber layer 27*d*, and the release layer 27*e*. The both side parts of the foamed rubber layer 83*b* and the metal conductive layer 27*c* are bonded by a silicon-series heat resistant adhesive. In the central part of the heat roller 83, space of about 0.5 mm is formed between the foamed rubber layer 83*b* and the metal conductive layer 27*c*.

When the power is turned ON as is the case with the above described first embodiment using the heat roller 83 having such a structure, a load concentrates on the both side parts of the heat roller 83 until the warm-up is completed. Note that, since the contact area of the core member 83*a* and the foamed rubber layer 83*b* is large, the stress generated in the inner periphery of the foamed rubber layer 83*b* in the both side ends is dispersed. Thereby, the breakage of the foamed rubber layer 83*b* due to distortion is avoided. Afterward, when the warm-up is completed, the image formation process is performed as is the case with the above described first embodiment.

According to the embodiment, as is the case with the first embodiment, the nip 30 can obtain uniform pressure across the entire length of the heat roller 81 in the shaft direction at the time of fixing, and uniform and good fixed images can be obtained across the entire length in the scan direction. Further, according to the embodiment, since the foamed rubber layer 83*b* meshes with the core member 83*a* in the concavo-convex shape across the entire length, the contact area of the core member 83*a* and the foamed rubber layer 83*b* is increased. Accordingly, the stress generated in the inner periphery of the foamed rubber layer 83*b* is dispersed, the breakage of the inner periphery of the foamed rubber layer 83*b* can be prevented, and a longer life of the heat roller 83 can be obtained.

The invention is not limited to the above embodiments, but various changes can be made within the scope of the invention. The properties of material, structure, shapes of the elastic layer are not limited, and, for example, the size or the like of the space between the elastic layer and the induction heating member is not limited as long as the space can absorb the thermal expansion of the elastic layer. Further, the elastic modulus of the elastic member is optional.

As has been described above in detail, according to the invention, the hardness of the heat roller can be made nearly uniform across the entire length in the shaft direction at the time of fixing. Therefore, the nip between the heat roller and pressurizing member is applied with uniform pressure across the entire length in the shaft direction, and good fixed images can be obtained. Further, according to the invention, the stress generated in the elastic layer by pressure contact with the pressurizing member can be dispersed. Thereby, the early breakage of the elastic layer with lower strength can be prevented and a longer life of the heating and rotating member can be obtained.

What is claimed is:

1. A fixing device for an image forming apparatus comprising:

a heating and rotating member formed by covering a surface of an elastic layer formed on an outer periphery of a core member, at least a part of which formed by laminating plural kinds of elastic members with a metal conductive layer, wherein hardness of the plural kinds of elastic members becomes smaller from the core member toward the surface of the elastic layer;

a heating mechanism that heats the metal conductive layer; and a pressurizing member that transports a recording medium together with the heating and rotating member while nipping and carrying the recording medium in between, wherein the plural kinds of elastic members are a solid rubber layer at the core member side and a foamed rubber layer that covers the solid rubber layer.

2. A fixing device for an image forming apparatus according to claim 1, wherein the elastic layer has outer diameters of the both side parts larger than that of a central part in the shaft direction of the heating and rotating member, and is bonded in the both side parts to the metal conductive layer.

3. A fixing device for an image forming apparatus according to claim 1, wherein the foamed rubber layer has a higher foaming rate than that of the solid rubber layer.

4. A fixing device for an image forming apparatus according to claim 1, wherein the part of the elastic layer formed by laminating the plural kinds of elastic members is one side opposite to the drive side in the shaft direction of the heating and rotating member.

5. A fixing device for an image forming apparatus according to claim 1, wherein a thickness of the solid rubber layer is thicker than that of the central part in the shaft direction at least in the one side part at the opposite side to the drive side in the shaft direction of the heating and rotating member.

6. A fixing device for an image forming apparatus according to claim 1, wherein the solid rubber layer is in nested contact with the foamed rubber layer.

* * * * *